US011049683B2

(12) United States Patent
Hong

(10) Patent No.: US 11,049,683 B2
(45) Date of Patent: Jun. 29, 2021

(54) HIGH-VOLTAGE DIRECT-CURRENT THERMAL FUSE

(71) Applicant: XIAMEN SET ELECTRONICS CO., LTD, Xiamen (CN)

(72) Inventor: Yaoxiang Hong, Xiamen (CN)

(73) Assignee: XIAMEN SET ELECTRONICS CO., LTD, Xiamen (CN)

( * ) Notice: Subject to any disclaimer, the term of this patent is extended or adjusted under 35 U.S.C. 154(b) by 0 days.

(21) Appl. No.: 16/623,932

(22) PCT Filed: Aug. 22, 2018

(86) PCT No.: PCT/CN2018/101788
§ 371 (c)(1),
(2) Date: Dec. 18, 2019

(87) PCT Pub. No.: WO2019/001590
PCT Pub. Date: Jan. 3, 2019

(65) Prior Publication Data

US 2020/0135422 A1 Apr. 30, 2020

(30) Foreign Application Priority Data

Jun. 30, 2017 (CN) ..... 201720786629.2

(51) Int. Cl.
*H01H 85/12* (2006.01)
*H01H 85/38* (2006.01)
(Continued)

(52) U.S. Cl.
CPC ..... *H01H 85/12* (2013.01); *H01H 37/761* (2013.01); *H01H 85/165* (2013.01); *H01H 85/38* (2013.01)

(58) Field of Classification Search
CPC ..... H01H 85/12; H01H 85/38; H01H 85/165; H01H 37/761
(Continued)

(56) References Cited

U.S. PATENT DOCUMENTS 3,721,935 A * 3/1973 Kozacka ..... H01H 85/055 337/164
3,810,063 A * 5/1974 Blewitt ..... H01H 85/47 337/166
(Continued)

FOREIGN PATENT DOCUMENTS

CN 1165390 A 11/1997
CN 201149844 Y 11/2008
(Continued)

OTHER PUBLICATIONS

"Thermal Fuse", Jul. 24, 2013, Shi Shengua, Entire Document (Translation of CN 203085467). (Year: 2013).*

*Primary Examiner* — Stephen S Sul
(74) *Attorney, Agent, or Firm* — Bayramoglu Law Offices LLC

(57) ABSTRACT

A high-voltage direct-current thermal fuse including: a fusible component having two fusible alloy support arms parallel to each other; a fluxing agent; a fusing cavity; and two pins. The fusible component and the fluxing agent are sealed within the fusing cavity. The two pins are respectively connected to the two support arms. Technically, the fluxing agent only needs to have contact with the fusible alloy. Practically, the fluxing agent is usually coated over the fusible alloy. The fusible component in the high-voltage direct-current thermal fuse of the present application is a U-shaped structure having two parallel support arms. A high electric field intensity is generated when an arc is being cut off, as a result, the electrons repel each other, and the arc is
(Continued)

lengthened, thereby increasing the speed of cutting off the arc.

19 Claims, 4 Drawing Sheets

(51) Int. Cl.
*H01H 37/76* (2006.01)
*H01H 85/165* (2006.01)

(58) Field of Classification Search
USPC ..... 337/142, 144, 158, 159, 161, 164, 256, 337/293, 335
See application file for complete search history.

(56) References Cited

U.S. PATENT DOCUMENTS 3,849,755 A * 11/1974 Blewitt ..... H01H 85/055 337/295
4,167,723 A * 9/1979 Wilks ..... H01H 85/42 337/161
4,309,684 A * 1/1982 Wilks ..... H01H 85/38 337/161
4,337,452 A * 6/1982 Kozacka ..... H01H 85/153 337/231
4,366,461 A * 12/1982 Tawfik ..... H01H 85/055 29/623
4,855,705 A * 8/1989 Narancic ..... H01H 69/02 337/246
5,659,284 A * 8/1997 Olofsson ..... H01H 85/048 337/290
5,841,338 A * 11/1998 Yasukuni ..... H01H 85/0411 337/293
5,858,454 A * 1/1999 Kiryu ..... H01H 85/0411 337/404
6,343,000 B1 * 1/2002 Yokoyama ..... F42B 3/124 102/202.4
6,570,482 B2 * 5/2003 Brown ..... H01H 85/11 337/159
2002/0181221 A1 * 12/2002 Ries ..... H01H 85/306 361/837
2003/0001716 A1 * 1/2003 Kaltenborn ..... H01H 85/046 337/273
2004/0166405 A1 * 8/2004 Senda ..... H01H 37/761 429/127
2010/0109833 A1 * 5/2010 Knab ..... H05K 1/0293 337/413
2011/0181385 A1 * 7/2011 Schulze-Icking-Konert ..... H01H 37/761 337/290
2015/0054614 A1 * 2/2015 Blewitt ..... H01H 85/0039 337/277
2015/0348731 A1 * 12/2015 Douglass ..... H01H 85/175 337/198
2015/0348732 A1 12/2015 Douglass et al.
2019/0228936 A1 * 7/2019 Yoneda ..... H01H 85/143

FOREIGN PATENT DOCUMENTS

CN 203071028 U 7/2013
CN 203085467 U * 7/2013
CN 203085467 U 7/2013
CN 103484720 A 1/2014
CN 203398063 U 1/2014
CN 203760407 U 8/2014
CN 203839326 U 9/2014
CN 205508751 U 8/2016
CN 206976273 U 2/2018

* cited by examiner

HIGH-VOLTAGE DIRECT-CURRENT THERMAL FUSE

CROSS REFERENCE TO THE RELATED APPLICATIONS

This application is the national phase entry of International Application No. PCT/CN2018/101788, filed on Aug. 22, 2018, which is based upon and claims priority of Chinese Patent Application No. 201720786629.2, filed to the China National Intellectual Property Administration on Jun. 30, 2017, the entire contents of which are incorporated herein by reference.

TECHNICAL FIELD

The present application relates to a fuse, in particular to a high-voltage direct-current thermal fuse.

BACKGROUND

China's electric-car market has been growing fast since 2014. The next 5-10 years are expected to be an important period for the industrialization of electric vehicles, and the market is expected to boom in the future. As the largest electric-car market in the world, in the year of 2015, China's annual new energy vehicle output reached 340,000 units and annual sales volume reached 330,000 units, with year-on-year growth of 3.3 and 3.4 times, respectively. In the whole year of 2016, the total sales volume of new energy vehicles in China reached 507,000 units, with year-on-year growth of 53%. It is estimated that the sales volume of new energy vehicles in 2017 and 2020 will reach 750,000 and 2 million units, and the penetration rate is expected to reach 6% in the year of 2020. As new energy vehicles are being promoted nationwide, growth within the industry is promising.

Batteries have always been the part that people care about the most in an electric car. However, Chinese car manufacturers and foreign car manufacturers have vastly different battery selection criteria. At present, Nissan Leaf is a car model having the highest market share, which has a battery voltage of 360 Vdc. Mitsubishi's i-MiEV has a battery voltage of 300 Vdc. A Tesla battery pack of 7000 pieces of 18650 lithium batteries has a voltage of only 400 Vdc. Battery pack voltage of China's electric vehicles is much higher than the battery pack voltage of cars manufactured by foreign car manufacturers. For example, the battery pack voltage of BYD Qin is 560 Vdc, while the battery pack voltage of BYD Tang is 700 Vdc.

Battery pack with high voltage has two advantages, lower energy/power loss and higher motor drive efficiency. Increasing the voltage will be a trend and should be a development direction in the future. Increasing the voltage of the battery pack will result in reduced working current while the output power stays the same as before the change. However, this has a great impact on the performance requirement/cost of peripheral devices. By using a battery pack having higher voltage, the protection devices used in circuits should be able to operate under high voltage conditions.

Chinese patent NO. 201420230161.5 discloses a high-voltage direct-current temperature fuse, which is the only high-voltage direct-current thermal protection device in the industry that can reach 15A 450 Vdc. However, among China's mainstream car manufacturers, the voltage of battery packs are all set above 500 Vdc, as a result there is an urgent need for a high-voltage direct-current protection device in the market.

SUMMARY

In order to solve the existing problems mentioned above, one of the purposes of the present application is to provide a high-voltage direct-current thermal fuse to provide an effective thermal protection for a circuit by shutting of the current to the circuit.

One of the purposes of the present application is achieved by the following technical solutions.

A high-voltage direct-current thermal fuse includes a fusible component having two fusible alloy support arms parallel to each other; a fluxing agent; a fusing cavity, wherein the fusible component and the fluxing agent are sealed within the fusing cavity; and two pins, wherein the two pins are respectively connected to the two support arms. Technically, the fluxing agent only needs to have contact with the fusible alloy. Practically, the fluxing agent is usually coated over the fusible alloy.

Preferably, the fusible component has a U-shaped, M-shaped, S-shaped or trapezoid-shaped structure.

Preferably, the high-voltage direct-current thermal fuse further includes an insulation block, and the insulation block is arranged between the two support arms and separates the two pins. This setting acts to lengthen the arc to increase the insulation tolerance of the pins during an arc extinction.

Preferably, the high-voltage direct-current thermal fuse further includes a housing and a bottom plate. The insulation block is arranged on the bottom plate. The housing, the bottom plate, the insulation block, and the two pins form the fusing cavity.

Preferably, a fusible alloy connection segment is connected between the two support arms.

Preferably, n conductive members and n−1 fusible alloy connection segments arranged at intervals are connected between the two support arms, and n is a natural number. When n is greater than or equal to 2, each fusible alloy connection segment is arranged between two conductive members, so as to ensure that the fusible alloy material and the conductive members are arranged at intervals, in an alternating method. Theoretically, any conductive material can be used as the conductive member of the present disclosure. Preferably, the conductive member uses the same material as the pins. On reaching the operating temperature, the fusible alloy contracts toward the two pins, and the contraction rate of the fusible alloy with excessive length will be slower. As a result, if the fusible alloy is applied to a high voltage structure, the high voltage cannot be cut off in time. The fusible alloy can be configured as multiple segments that are alternatingly arranged with the conductive members to improve the contraction rate of the fusible alloy.

Preferably, one conductive member is connected between the two support arms.

Preferably, two conductive members and one fusible alloy connection segment arranged between the two conductive members are connected between the two support arms.

Preferably, when n is greater than or equal to 3, the cross-sectional areas of the fusible alloy connection segments may differ from one another, and the operating temperature of the fusible alloy connection segment having a smaller cross-sectional area is higher than the operating temperature of the fusible alloy connection segment having a larger cross-sectional area. By doing so, while improving the current handling capability in per unit volume, the ability of cutting of the circuit with high voltage is also improved. After other fusible alloys are disconnected, The fusible alloy having a high operating temperature and a small cross-sectional area can contract faster to cut off the arc under the action of the temperature and the current after other fusible alloys are disconnected.

Preferably, a place at which the support arms, the fusible alloy connection segment, and the conductive member are connected is provided with connection holes, and the conductive member is placed in the connection hole for welding. This welding mode is better than welding the fusible alloy and conductive member with flat surfaces.

Preferably, the two pins are perpendicular to the support arms.

Preferably, a non-metallic partition film is arranged inside the fusing cavity to divide the fusing cavity into an inner cavity and an outer cavity, and the inner cavity and the outer cavity are mutually sealed; the fluxing agent is arranged inside the inner cavity, and quartz sand is arranged inside the outer cavity. In high voltage application, arc cutting process easily gasifies and expands the fluxing agent. The quartz sand can absorb the impact of gasification and block the transmission path of the arc, which is favorable for improving the insulation withstanding voltage of the opening points.

Preferably, the high-voltage direct-current thermal fuse includes a plurality fusible components connected in parallel.

Preferably, conductive members having equal electric potential in the plurality of fusible components connected in parallel can be integrated into one body. When a plurality of fusible components having one conductive member are connected in parallel, all of the conductive members can be integrated into one body. By doing so, the structure is simplified and the processing is easier.

Preferably, the fusible component may have a hollow tube structure, and the fluxing agent is placed inside the tube. By doing so, the surface oxide layer of fusible alloy can be activated more effectively, and the arc can be cut off quickly.

Preferably, an external connection part of each pin is wavy on one side, near the fusing cavity and is flat on the other side away from the fusing cavity.

The present application has the following advantages.

The fusible components of the high-voltage direct-current thermal fuse in this application is a U-shaped structure having two support arms parallel to each other. A high electric field intensity is generated when an arc is being cut off, as a result, the electrons repel each other, and the arc is lengthened, thereby increasing the speed of cutting off the arc. Therefore, this invention can be used to provide thermal protection for high-voltage direct-current power devices. When an abnormal heating condition occurs and the temperature reaches the operating temperature point of the fusible alloy, the cutting off operation can be performed quickly to protect the circuit, therefore providing a safe operating condition.

BRIEF DESCRIPTION OF THE DRAWINGS

The present application will be further described below with reference to the following drawings.

Figure 1:
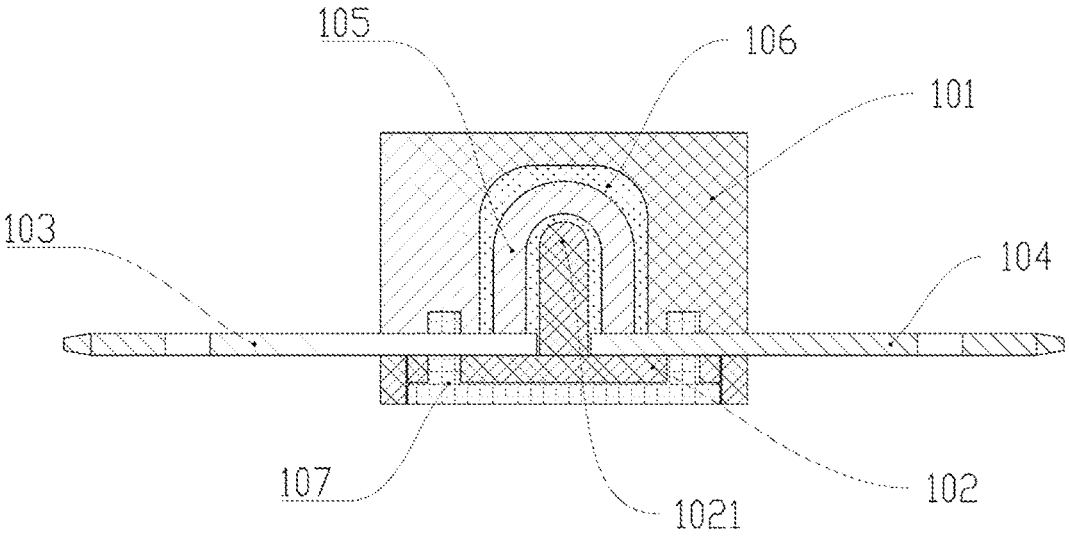
FIG. 1 is a cross-sectional view of the high-voltage direct-current thermal fuse according to Embodiment 1 in the present application.

The reference numerals in the drawings are illustrated below:

101 housing
102 bottom plate
1021 insulation block
103 left pin
104 right pin
105 fusible alloy
106 fluxing agent
107 encapsulation adhesive
108 non-metallic partition film
109 quartz sand
201 housing
202 bottom plate
203 left pin
204 right pin
205 first support arm
206 conductive member
207 second support arm
208 fluxing agent
209 encapsulation adhesive
210 non-metallic partition film
211 quartz sand
301 housing
302 bottom plate
303 left pin
304 right pin
305 first support arm
306 first conductive member
307 fusible alloy connection segment
308 second conducive member
309 second support arm
310 fluxing agent
311 encapsulation adhesive
401 connection hole

DETAILED DESCRIPTION OF THE EMBODIMENTS

Embodiment 1

Figure 2:
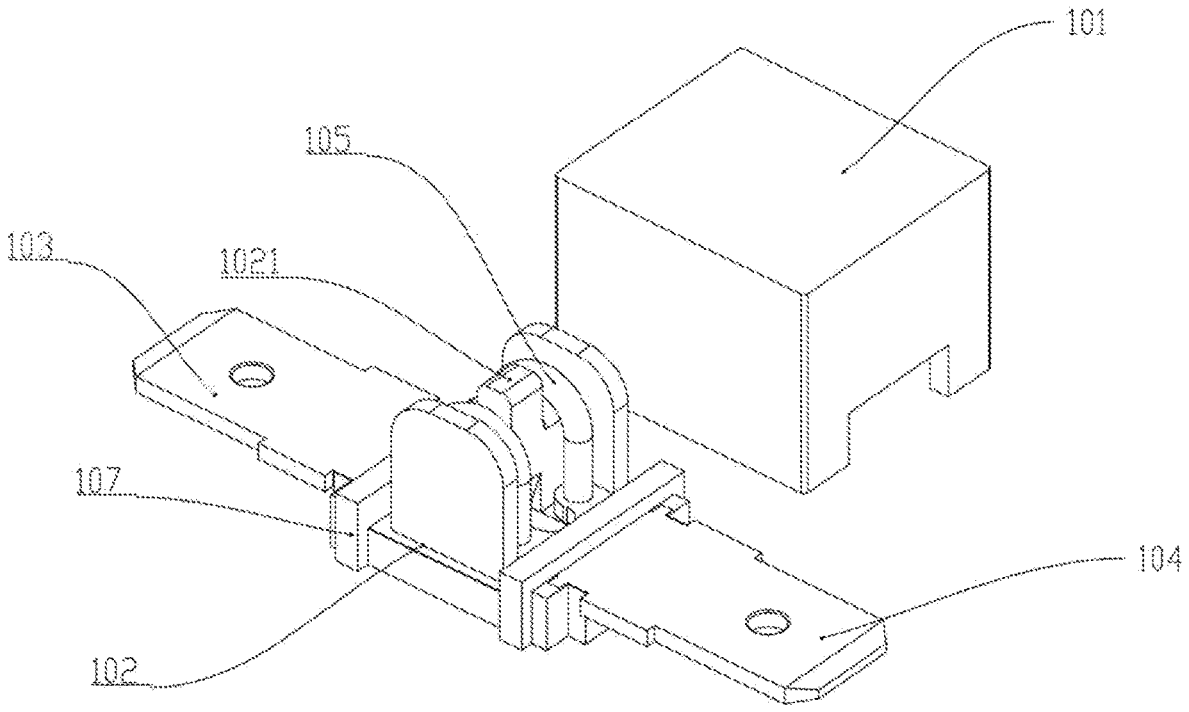
FIG. 2 is an exploded view of the high-voltage direct-current thermal fuse according to Embodiment 1 in the present application.

As shown in FIG. 1 and FIG. 2, the high-voltage direct-current thermal fuse includes the non-metallic housing 101, the bottom plate 102, and the insulation block 1021 arranged on the bottom plate 102. The housing 101 and the bottom plate 102 are sealed with the encapsulation adhesive 107. The housing 101, the bottom plate 102, the left pin 103, the right pin 104, and the insulation block 1021 form the fusing cavity, and two fusible components coated with the fluxing agent 106 are hermetically arranged in the fusing cavity. The fusible component is a U-shaped structure having two fusible alloy support arms parallel to each other and fusible alloy connection segments connecting the two support arms. Namely, the fusible component is a U-shaped fusible alloy 105. The left pin 103 and the right pin 104 are perpendicular to the fusible alloy support arms. An end of the left pin 103 is connected to a support arm at a side and the other end of the left pin 103 extends out of the housing 101. One end of the right pin 104 is connected to the other support arm at the other side and the other end of the right pin 104 extends out of the housing 101. The insulation block 1021 is arranged between the parallel support arms and separates the left pin 103 and the right pin 104. The left pin 103, the fusible alloy 105, and the right pin 104 form the fusing component of an electrical connection.

When the high-voltage direct-current thermal fuse is applied in the thermal protection of a power device in high-voltage circuits, when the power device operates in unusual conditions, the temperature would rise abnormally. The heat is transferred to the fluxing agent 106 and the fusible alloy 105 through the left pin 103, the right pin 104, and the housing 101, the temperature transfer the fluxing agent 106 from solid state to liquid state and activate the surface oxide layer of the fusible alloy 105. When the temperature reaches the operating temperature point of the fusible alloy 105, the fusible alloy 105 starts to creep and contract toward the left pin 103 and the right pin 104. When the fusible alloy 105 is broken, a high-voltage arc is generated, and the opening point of the fusible alloy 105 is rapidly eroded by electricity. When the fusible alloy 105 reaches the two parallel support arms after contraction and electrical erosion, the high electric field intensity generated by the breaking of the fusible alloy 105 makes the electrons of the two support arms repel each other, the arc is lengthened, and the arc is rapidly cut off, thus cutting off the circuit. The insulation block 1021 of the bottom plate 102 functions to lengthen the arc and increase the insulation voltage withstanding capability of the left pin 103 and the right pin 104 in the arc extinction.

Embodiment 2

Figure 3:
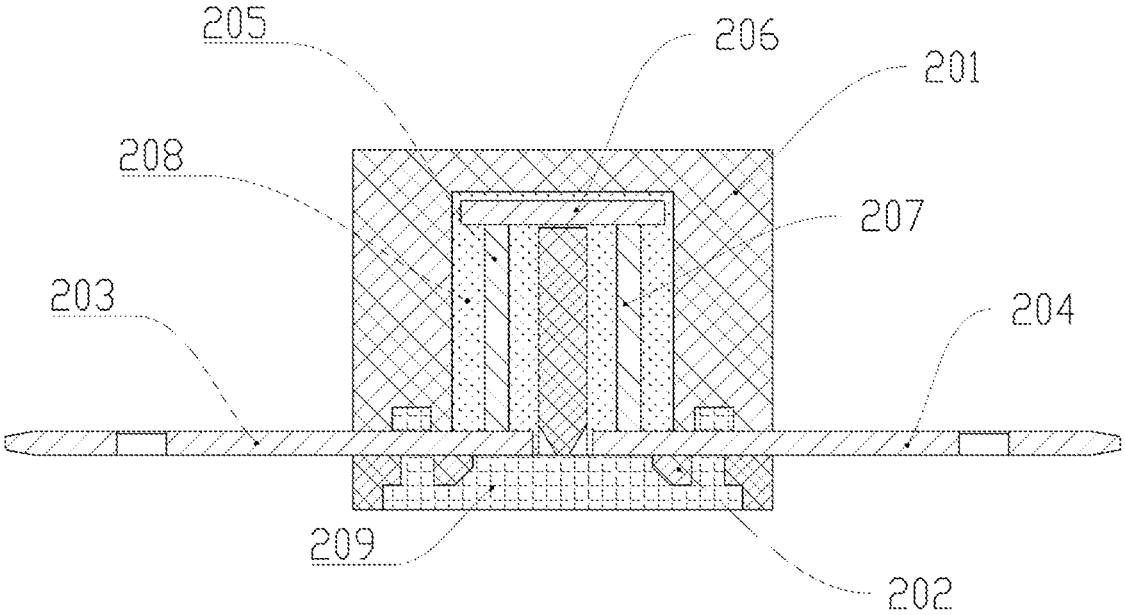
FIG. 3 is a cross-sectional view of the high-voltage direct-current thermal fuse according to Embodiment 2 in the present application.
Figure 4:
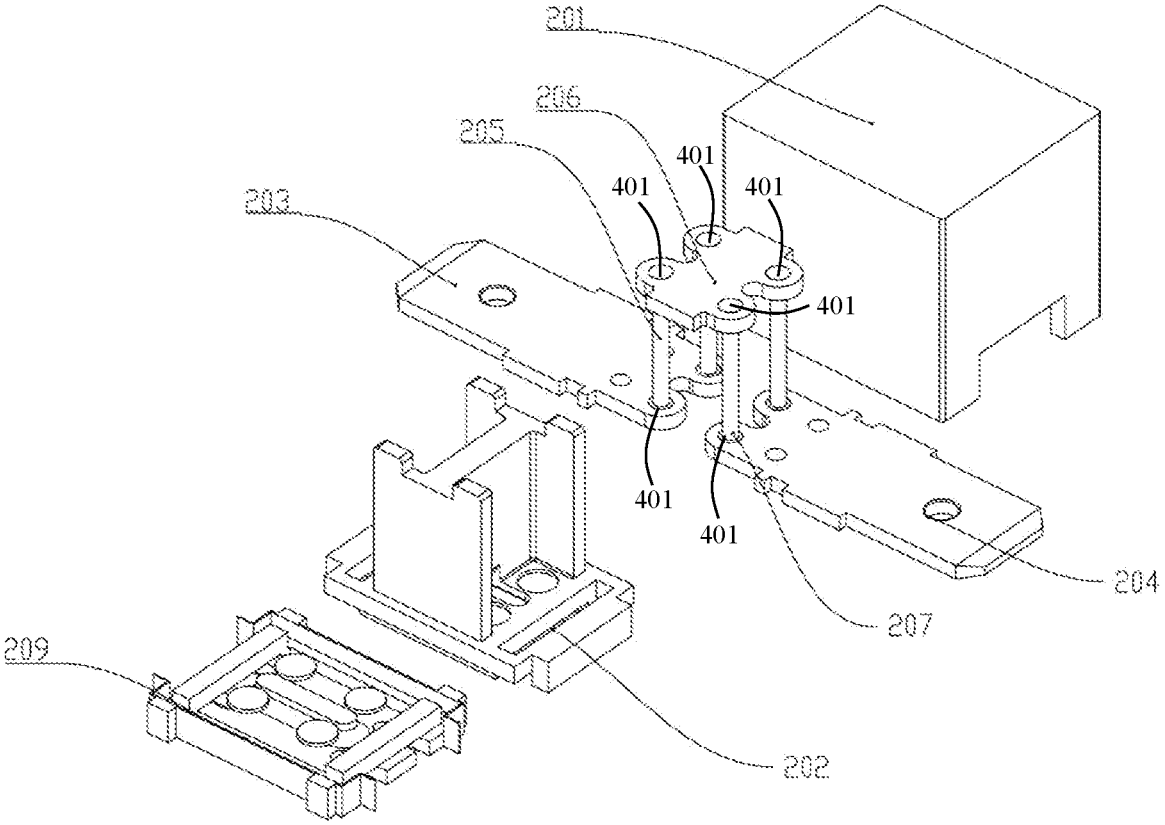
FIG. 4 is an exploded view of the high-voltage direct-current thermal fuse according to Embodiment 2 in the present application.

As shown in FIG. 3 and FIG. 4, the high-voltage direct-current thermal fuse includes the non-metallic housing 201, the bottom plate 202, and the insulation block arranged on the bottom plate 202. The housing 201 and the bottom plate 202 are sealed with the encapsulation adhesive 209. The housing 201, the bottom plate 202, the left pin 203, the right pin 204, and the insulation block form the fusing cavity, and two fusible components coated with the fluxing agent 208 are hermetically arranged in the fusing cavity. The fusible component is a U-shaped structure having the first support arm 205 and the second support arm 207 which are made of fusible alloy and are parallel to each other. The first support arm 205 and the second support arm 207 are connected by the conductive member 206. The insulation block is arranged between the first support arm 205 and the second support arm 207 and separates the left pin 203 and the right pin 204. The left pin 203 and the right pin 204 are perpendicular to the first support arm 205 and the second support arm 207. An end of the left pin 203 is connected to the first support arm 205 of the fusible component and the other end of the left pin 203 extends out of the housing 201. An end of the right pin 204 is connected to the second support arm 207 of the fusible component and the other end of the right pin 204 extends out of the housing 201. The left pin 203, the first support arm 205, the conductive member 206, the second support arm 207, and the right pin 204 are electrically connected successively to form a structure with two breaking points.

On reaching the operating temperature, the fusible alloy contracts toward the two pins, and the fusible alloy with an excessive length will have a slower contraction rate. As a result, if the fusible alloy is applied to a high voltage structure, the high voltage cannot be cut off in time. The fusible component may be configured as two fusible alloy segments that are separate and parallel to each other. The conductive member is connected between the two fusible alloy segments as a bridge to form an electrical connection.

The first support arm 205 and the second support arm 207 having the same operating temperature would absorb heat and contract toward the metal members at the two sides at the same time on reaching the operating temperature, thereby ensuring that the breaking point falls within the region of the parallel structure, improving the electric field intensity, accelerating the diffusion speed of the charged ions, shortening the length of the fusible alloy, forming multiple breaking points at the same time, increasing the voltage drop and loss, reducing the energy of the arc, and facilitating to cut off the high voltage circuit.

Embodiment 3

Figure 5:
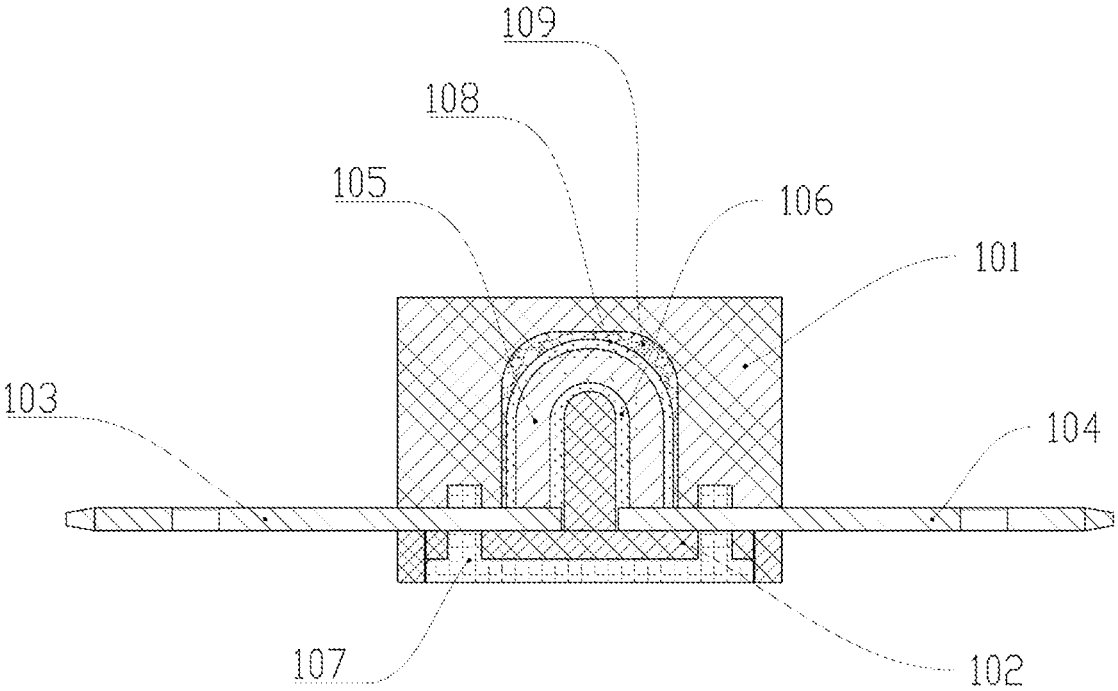
FIG. 5 is a cross-sectional view of the high-voltage direct-current thermal fuse according to Embodiment 3 in the present application.

As shown in FIG. 5, the high-voltage direct-current thermal fuse is a variant of Embodiment 1. On the basis of Embodiment 1, on the outer layer of the fusible alloy 105 coated with the fluxing agent 106, the non-metallic partition film 108 is used to divide the fusing cavity into an inner cavity and an outer cavity that are mutually sealed. The quartz sand 109 is arranged in the outer cavity, and the fluxing agent 106 is arranged in the inner cavity. The inner cavity and the outer cavity are partitioned to prevent the fluxing agent 106 from penetrating into the quartz sand 109 at a high temperature, and to prevent the quartz sand 109 from penetrating the fluxing agent 106 to destroy the surface structure of the fusible alloy 105.

When the fusible alloy 105 contracts and melts to break, a high-voltage arc is generated. The arc instantaneously and electrically erodes the opening point of the fusible alloy 105, causing instantaneous gasification and expansion of the fusible alloy which impacts the non-metal partition film 108. Under the action of the impact wave, the non-metal partition film 108 gets fractured, and the quartz sand 109 falls down to cover the fusible alloy 109, thereby interrupting the high-voltage arc, forming multiple breaking points, and extinguishing the arc instantaneously, which can effectively cut off the circuit.

Embodiment 4

Figure 6:
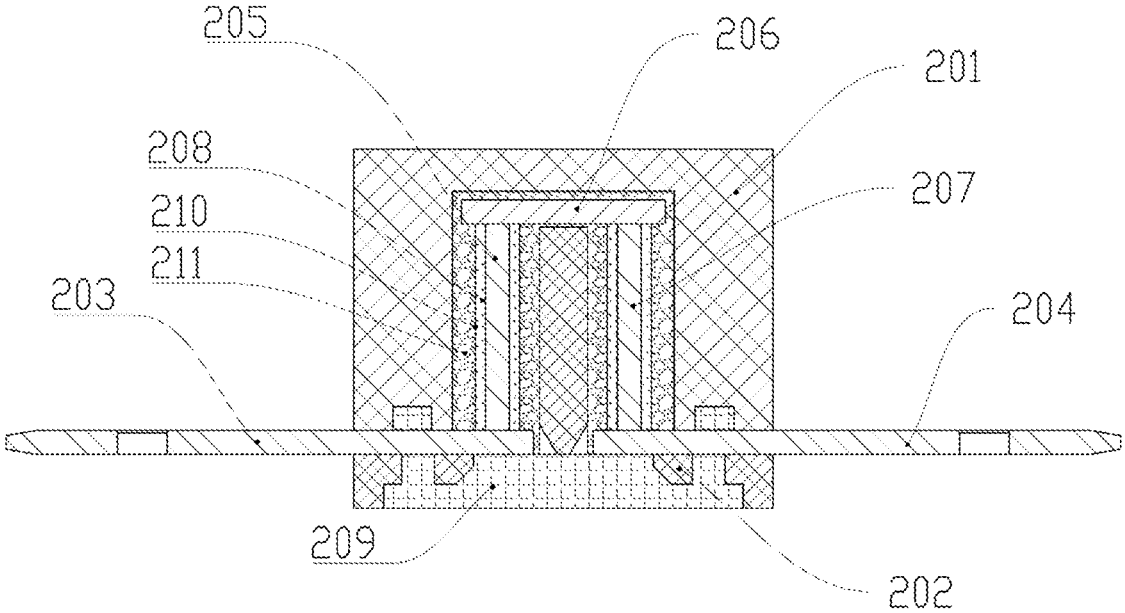
FIG. 6 is a cross-sectional view of the high-voltage direct-current thermal fuse according to Embodiment 4 in the present application.

As shown in FIG. 6, the high-voltage direct-current thermal fuse is a variant of Embodiment 2. On the basis of Embodiment 2, the partition film structure is used in a double breaking point structure. On the outer layer of the first support arm 205 and the second support arm 207 coated with the fluxing agent 208, the partition film 210 is used to separate the quartz sand 211 and the fluxing agent 208. In the fusing process, the arc is cut off at multiple breaking points to prevent further development of the arc.

Embodiment 5

Figure 7:
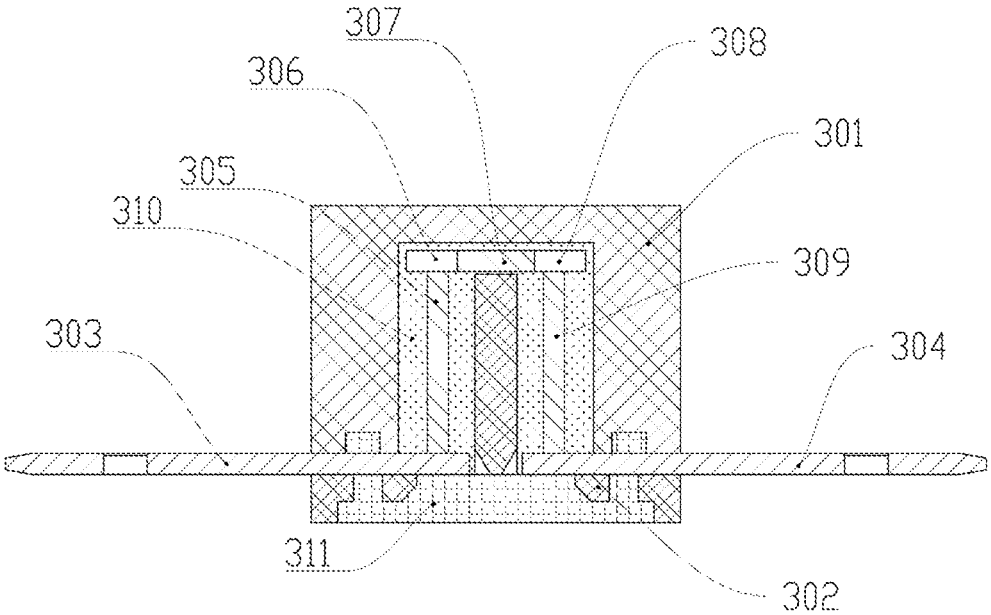
FIG. 7 is a cross-sectional view of the high-voltage direct-current thermal fuse according to Embodiment 5 in the present application.

As shown in FIG. 7, according to the level of the voltage to be cut, the fusible alloy may be configured as more segments, and a conductive member is used as a bridge between every two fusible alloy segments to form a linear electrical connection in sequence.

High-voltage direct-current thermal fuse includes the non-metallic housing 301, the bottom plate 302, and the insulation block arranged on the bottom plate 302. The housing 301 and the bottom plate 302 are sealed with the encapsulation adhesive 311. The housing 301, the bottom plate 302, the left pin 303, the right pin 304, and the insulation block form the fusing cavity, and the fusible component coated with the fluxing agent 310 is hermetically arranged inside the fusing cavity. The fusible component is a U-shaped structure having the first support arm 305 and the second support arm 309 that are made of fusible alloy and are parallel to each other. The first support arm 305 and the second support arm 309 are connected by the first conductive member 306, the fusible alloy connection segment 307, and the second conductive member 308 that are arranged at intervals. The insulation block is arranged between the first support arm 305 and the second support arm 309 and separates the left pin 303 and the right pin 304. The left pin 303 and the right pin 304 are perpendicular to the first support arm 305 and the second support arm 309. An end of the left pin 303 is connected to the first support arm 305 of the fusible component and the other end of the left pin 303 extends out of the housing 301. An end of the right pin 304 is connected to the second support arm 309 of the fusible component and the other end of the right pin 304 extends out of the housing 301. The left pin 303, the first support arm 305, the first conductive member 306, the fusible alloy connection segment 307, the second conductive member 308, the second support arm 309, and the right pin 304 are electrically connected successively to form a multiple breaking point structure. The fluxing agent 310 is coated on the surfaces of the first support arm 305, the fusible alloy connection segment 307, and the second support arm 309. The first support arm 305, the fusible alloy connection segment 307, and the second support arm 309 have the same operating temperature and form a multiple breaking point structure when fusing simultaneously, thereby increasing the voltage drop and loss and reducing the energy of the arc, so the thermal protection can be effectively performed.

Figure 8:
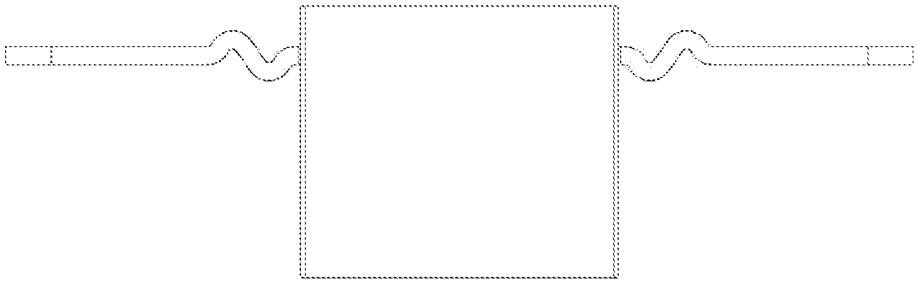
FIG. 8 shows one embodiment of the pins according to the present disclosure.

FIG. 8 shows one embodiment of the pins. It is shown in the drawing that an external connection part of each pin is wavy at a side near the fusing cavity and is flat at a side away from the fusing cavity.

The present application has been described in detail in the form of embodiments with reference to the drawings. Described embodiments are merely preferred embodiments of the present application and are not intended to limit the present application. Although the present application has been described in detail with reference to the embodiments, for those skilled in the art, the technical solutions described in the foregoing embodiments may be modified, or some of the technical features may be equivalently replaced. Any changes, equivalent substitution, improvement, and so on made without departing from the spirit and principle of this application shall be considered as falling within the scope of this application.

What is claimed is:

1. A high-voltage direct-current thermal fuse, comprising:

a fusible component having fusible alloy support arms, wherein the fusible alloy support arms do not intersect;

a fluxing agent;

a fusing cavity, wherein the fusible component and the fluxing agent are sealed within the fusing cavity; and pins, wherein the pins are respectively connected to the fusible alloy support arms;

wherein n conductive members and n−1 fusible alloy connection segments arranged at intervals are connected between the fusible alloy support arms, and n is a natural number; when n is greater than or equal to 2, each of the n−1 fusible alloy connection segment is arranged between the n conductive members.

2. The high-voltage direct-current thermal fuse according to claim 1, wherein the fusible component has a U-shaped, M-shaped, S-shaped or trapezoid-shaped structure; the fusible alloy support arms and the pins are connected in a one-to-one correspondence manner.

3. The high-voltage direct-current thermal fuse according to claim 2, further comprising an insulation block, wherein the insulation block is arranged between the fusible alloy support arms and separates the pins.

4. The high-voltage direct-current thermal fuse according to claim 2, wherein a fusible alloy connection segment is connected between the fusible alloy support arms.

5. The high-voltage direct-current thermal fuse according to claim 2, wherein the pins are perpendicular to the fusible alloy support arms.

6. The high-voltage direct-current thermal fuse according to claim 1, further comprising an insulation block, wherein the insulation block is arranged between the fusible alloy support arms and separates the pins.

7. The high-voltage direct-current thermal fuse according to claim 6, further comprising a housing and a bottom plate; wherein the insulation block is arranged on the bottom plate; the housing, the bottom plate, the insulation block, and the pins form the fusing cavity.

8. The high-voltage direct-current thermal fuse according to claim 1, wherein a fusible alloy connection segment is connected between the fusible alloy support arms.

9. The high-voltage direct-current thermal fuse according to claim 1, wherein one of the n conductive members is connected between the fusible alloy support arms.

10. The high-voltage direct-current thermal fuse according to claim 1, wherein n conductive members comprise two conductive members and the n−1 fusible alloy connection segments comprise one fusible alloy connection segment arranged between the two conductive members are connected between the fusible alloy support arms.

11. The high-voltage direct-current thermal fuse according to claim 1, wherein when n is greater than or equal to 3, cross-sectional areas of the fusible alloy connection segments differ from one another, and an operating temperature of the fusible alloy connection segment having a smaller cross-sectional area is higher than an operating temperature of the fusible alloy connection segment having a larger cross-sectional area.

12. The high-voltage direct-current thermal fuse according to claim 1, wherein a place at which the fusible alloy support arms, the n−1 fusible alloy connection segments, and the n conductive members are connected is provided with connection holes.

13. The high-voltage direct-current thermal fuse according to claim 1, wherein the pins are perpendicular to the fusible alloy support arms.

14. The high-voltage direct-current thermal fuse according to claim 1, wherein the fusible component comprises a plurality fusible components connected in parallel.

15. The high-voltage direct-current thermal fuse according to claim 14, wherein conductive members having equal electric potential in the plurality of fusible components connected in parallel are integrated into one body.

16. The high-voltage direct-current thermal fuse according to claim 1, wherein the fusible component has a hollow tube structure, and the fluxing agent is placed in the hollow tube structure.

17. The high-voltage direct-current thermal fuse according to claim 1, wherein an external connection part of each pin is wavy at a side near the fusing cavity and is flat at a side away from the fusing cavity.

18. A high-voltage direct-current thermal fuse comprising:

a fusible component having fusible alloy support arms, wherein the fusible alloy support arms do not intersect;

a fluxing agent;

a fusing cavity, wherein the fusible component and the fluxing agent are sealed within the fusing cavity; and pins, wherein the pins are respectively connected to the fusible alloy support arms;

wherein a non-metallic partition film is arranged inside the fusing cavity to divide the fusing cavity into an inner cavity and an outer cavity, and the inner cavity and the outer cavity are mutually sealed; the fluxing agent is arranged inside the inner cavity, and a quartz sand is arranged inside the outer cavity.

19. A high-voltage direct-current thermal fuse comprising:

a fusible component having fusible alloy support arms, wherein the fusible alloy support arms do not intersect;

a fluxing agent;

a fusing cavity, wherein the fusible component and the fluxing agent are sealed within the fusing cavity; and pins, wherein the pins are respectively connected to the fusible alloy support arms;

wherein the fusible component has a U-shaped, M-shaped, S-shaped or trapezoid-shaped structure; the fusible alloy support arms and the pins are connected in a one-to-one correspondence manner;

wherein n conductive members and n−1 fusible alloy connection segments arranged at intervals are connected between the fusible alloy support arms, and n is a natural number; when n is greater than or equal to 2, each of the n−1 fusible alloy connection segment is arranged between n conductive members.

* * * * *